United States Patent [19]

Peekna

[11] 4,282,998

[45] Aug. 11, 1981

[54] MAINTENANCE OF CONSTANT WEB CLEARANCE AT CONTACTLESS TURNING GUIDE

[75] Inventor: Andres Peekna, Green Bay, Wis.

[73] Assignee: W. R. Grace & Co., New York, N.Y.

[21] Appl. No.: 148,197

[22] Filed: May 9, 1980

[51] Int. Cl.[3] ..... B65H 17/32

[52] U.S. Cl. ..... 226/97; 226/196; 242/76

[58] Field of Search ..... 226/97, 95, 91, 93, 226/118, 119, 196, 200; 242/76

[56] References Cited

U.S. PATENT DOCUMENTS

| | | | |
|---|---|---|---|
| 3,405,855 | 10/1968 | Daly | 226/97 X |
| 3,521,802 | 7/1970 | Bossons | 226/97 |
| 4,182,472 | 1/1980 | Peekna | 242/76 X |
| 4,197,973 | 4/1980 | Doane | 226/97 |
| 4,197,992 | 4/1980 | Doane | 226/97 |

*Primary Examiner*—Edward J. McCarthy
*Attorney, Agent, or Firm*—James E. Nilles

[57] ABSTRACT

In a contactless turning guide controlling a running web through a change of direction, pressure air from a source thereof is delivered into a plenum chamber, from which it issues through slots that direct it between the web and a curved guide surface, to form a pressurized air cushion on which the web floats out of contact with said surface. A damper that controls flow of pressure air into the plenum chamber is automatically so positioned by a servo as to maintain a constant distance between said surface and the web, notwithstanding variations in web tension. For control of the servo, a supply pressure sensor produces a first output corresponding to above-atmospheric pressure of air in the plenum chamber, a cushion pressure sensor having an inlet at said surface produces a second output corresponding to above-atmospheric pressure in the air cushion, and a ratio-forming device to which said outputs are fed produces a ratio signal corresponding to a ratio relationship between the first and second outputs. In a comparison device, the ratio signal is compared with a manually adjustable set-point signal to produce a control output which is so applied to the servo as to maintain said ratio relationship substantially constant.

8 Claims, 3 Drawing Figures

MAINTENANCE OF CONSTANT WEB CLEARANCE AT CONTACTLESS TURNING GUIDE

FIELD OF THE INVENTION

This invention relates to contactless turning guides of the type having a curved surface whereby a running web is guided through a change in direction along its length while floating on a cushion of pressure air that holds it out of contact with said surface; and the invention is more particularly concerned with a method and means for automatically maintaining a substantially constant distance between a running web and the curved surface of a turning guide notwithstanding substantial variations in tension on the web.

BACKGROUND OF INVENTION

In web printing and web coating apparatus, provision must often be made for contactless support of a substantially long stretch of web that directly follows a printing or coating station, to prevent smearing or other damage to the freshly applied printing ink or coating material. For such contactless support the web is floated on a cushion of pressurized air. Usually there are one or more locations at which the air supported portion of the web must be guided through a change of direction, and at each such location the web is controlled for its change of direction by means of a contactless turning guide, sometimes referred to in the art as an "air turn."

As in the structure disclosed in U.S. Pat. No. 4,182,472, which can serve by way of example, a turning guide has a curved exterior surface around which the web is guided and has a hollow interior that comprises a plenum chamber into which pressurized supply air is fed. The pressure air issues from the plenum chamber through slot-like outlets that open to the curved guide surface, to maintain a cushion of pressure air between the web and said surface. The distance between the guide surface and the web—which can be designated the web clearance—is normally on the order of 1/16 to $\frac{1}{8}$ inch.

For a given web tension, the web clearance depends upon the pressure and rate of flow of the pressurized supply air fed to the plenum chamber, increasing with increasing pressures and flow rates. On the other hand, if web tension is relaxed while the flow of air into the plenum chamber is maintained constant, the web tends to balloon away from the turning guide surface and flutter, becoming laterally uncontrollable; whereas if web tension is substantially increased without an increase in supply air, the web may drag against the turning guide.

Usually the pressure air source is a fan or blower, and a damper controls the rate at which air flows from the fan into the turning guide plenum chamber. Normally, a fixed setting of the damper is adequate for a given set of running conditions, but it is almost always necessary to change the damper setting during start-up, stopping or shut-down because of substantial changes in web tension at those times. The need for manually controlling or effecting changes in damper setting imposes a heavy work load on operating personnel at times when they are busiest, and therefore there has been a long-standing need for automatic means for controlling the position of the supply air damper in accordance with web tension, in order to maintain a substantially constant web clearance.

Several types of devices have been proposed for effecting automatic control of damper setting. Heretofore it has been thought that a basic element necessary for such automatic control was a sensor for detecting the distance between the web and the curved turning guide surface and for producing a damper-controlling output corresponding to a function of that distance.

Consideration has been given to several types of distance sensing devices for this purpose, but all of them are significantly objectionable in one way or another. High frequency electrical eddy current devices are generally satisfactory for measuring small distances, but such devices function only with electrically conducting materials and are therefore useless with most paper and plastic webs. Ultrasonic devices have been used for distance measurement on some automatically focusing cameras, and have been employed for accurate measurement of small distances on metal parts, but when an ultrasonic signal has to traverse air it does not afford the resolution needed for accurate measurement of such small distances as must be maintained between a web and a turning guide surface. A pneumatic nozzle for sensing back pressure would have to open towards the surface of the web remote from the turning guide in order not to be affected by cushion air pressure variations as well as by web clearance changes; and although such a nozzle could produce an output related to web clearance distance, it would have to be so close to the web, in order to have the required sensitivity, that the web would be likely to drag against it with any substantial decrease in web tension, and the nozzle would in any case be in the way during web threading. Most optical distance sensing devices would not be satisfactorily operative under all conditions; as, for example an optical distance sensor responsive to reflectivity of the web would be confused by a printed web. An optical sensor operating on the basis of reflection geometry such as angle of reflection, although theoretically satisfactory, would be unduly expensive.

The present invention takes a fundamentally different and unobvious approach to the problem, in that it rests upon the premise that a proximity sensor or distance measuring device is unnecessary for maintenance of a constant distance between the web and the curved surface of a turning guide. Instead, the present invention provides a method and means for utilizing a relationship that is inherent in the properties of the turning guide itself to accomplish automatic control of the supply of pressure air to the plenum chamber in the turning guide for maintenance of a substantially constant web clearance.

SUMMARY OF INVENTION

The general object of this invention is to provide an inexpensive but very effective method and means for automatically so regulating the flow of supply air to the plenum chamber of a contactless web turning guide as to maintain a substantially constant distance between the web and the curved surface of the turning guide regardless of variations in web tension.

More specifically, it is an object of this invention to provide an automatic method and means whereby the flow of supply air is regulated without the use of a sensor that measures the distance between the web and the curved guiding surface of the turning guide and wherein, instead, web clearance control is based upon magnitudes that are easily measured with inexpensive and generally conventional pressure sensing devices.

From a method standpoint it is an object of this invention to provide for the automatic regulation of the flow of supply air to a web turning guide on the basis of a pair of easily made air pressure measurements, the flow of supply air being adjusted to compensate for any departure from a fixed ratio relationship between the measured pressure magnitudes in order to maintain that relationship substantially constant notwithstanding variations in web tension.

From an apparatus standpoint it is an object of the invention to provide for automatic control of supply air to a web turning guide by means of a pair of sensors, each of which produces an output corresponding to a prevailing air pressure, a comparison device to which the outputs of said sensors are fed and by which a ratio relationship between those outputs is compared with a set point value to produce a control output, and a servo to which said control output is fed and which, in turn, adjusts a damper or the like that regulates the flow of supply air to maintain said ratio relationship constant.

It is a more specific object of the invention to provide apparatus of the character described wherein one of said sensors is responsive to the pressure of supply air and is located at or near the turning guide plenum chamber, and the other of said sensors is arranged to measure the pressure of air in the air cushion between the web and the curved surface of the turning guide, the last-mentioned sensor thus having an inlet located at said surface.

In its method aspect the present invention provides for operation of apparatus comprising a contactless turning guide which controls a running web for a change in direction along its length. The turning guide has an interior that comprises a plenum chamber into which pressurized supply air is fed, an exterior curved surface that the web follows for change in its running direction, and outlets through which air issues from said plenum chamber for maintenance of a pressurized air cushion between said surface and the web whereby the web is held at a distance from said surface. The method of this invention enables the distance between said turning guide surface and the web to be maintained substantially constant notwithstanding substantial variations in web tension, and said method is characterized by measuring the pressure of air in said air cushion at a location adjacent to said surface, and so controlling the pressure of air in said plenum chamber as to maintain the same in a substantially constant ratio relationship to pressure of air in said air cushion.

From an apparatus standpoint the invention contemplates an air guide of the above described character, in combination with an adjustable damper for regulating the flow of pressurized supply air and servo means for adjustingly controlling the damper; and the invention is characterized by a first sensor having an inlet at said curved guiding surface on the turning guide, for producing a cushion pressure output substantially corresponding to the pressure of air in said air cushion; a second sensor for producing a supply pressure output substantially corresponding to the pressure of air in said plenum chamber; and comparison means having connections with said first and second sensors and with said servo means, arranged to produce a signal corresponding to a ratio relationship between said cushion pressure output and said supply pressure output and to compare said signal with a set-point signal and to issue to said servo means a control output corresponding to the difference between said compared signals and whereby said servo means is caused to so adjust the damper means as to maintain said ratio relationship substantially constant.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
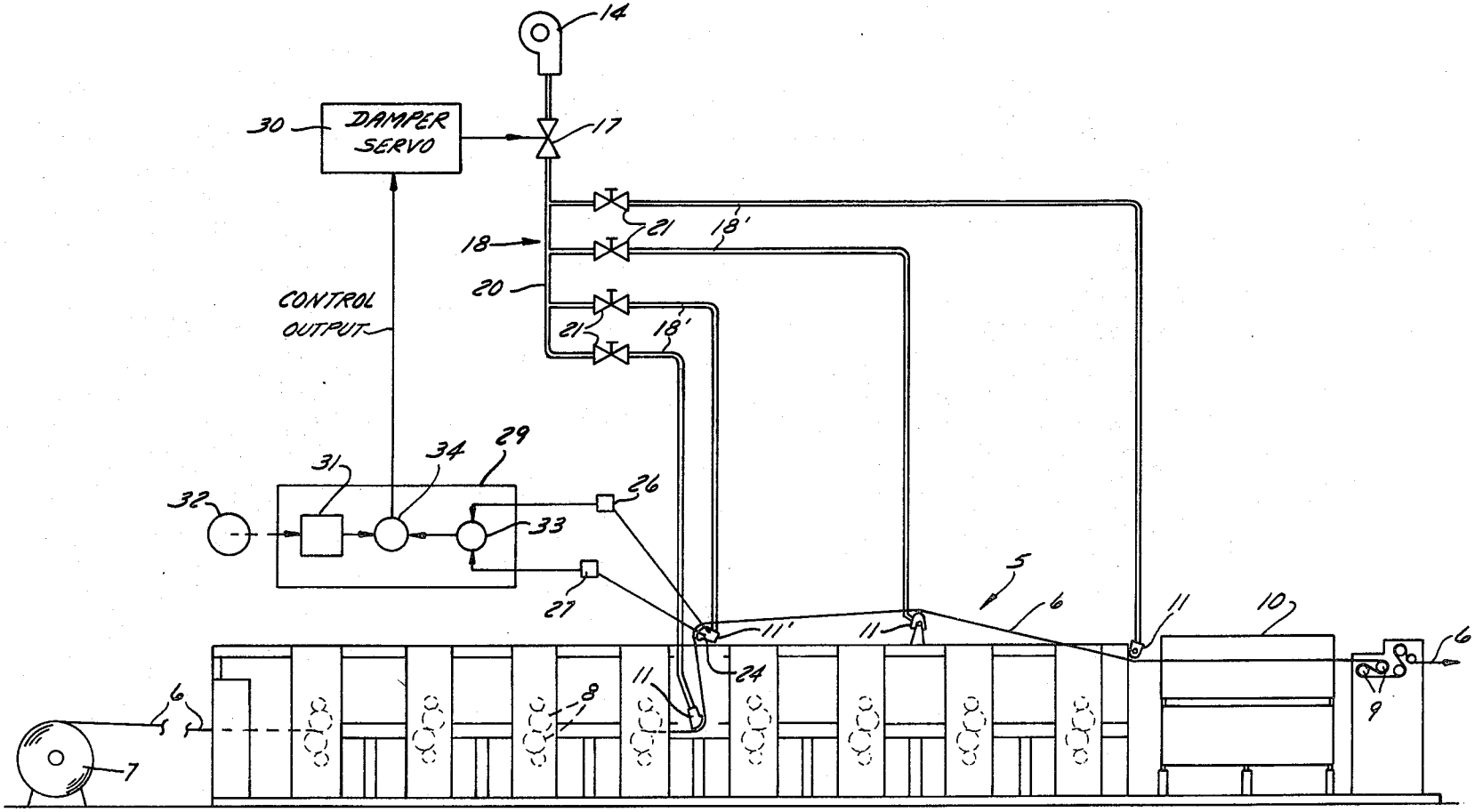
FIG. 1 is a diagrammatic view in side elevation of a portion of a web press or web coating apparatus wherein a length of running web is contactlessly supported and guided and which incorporates the method and means of this invention.
Figure 3:
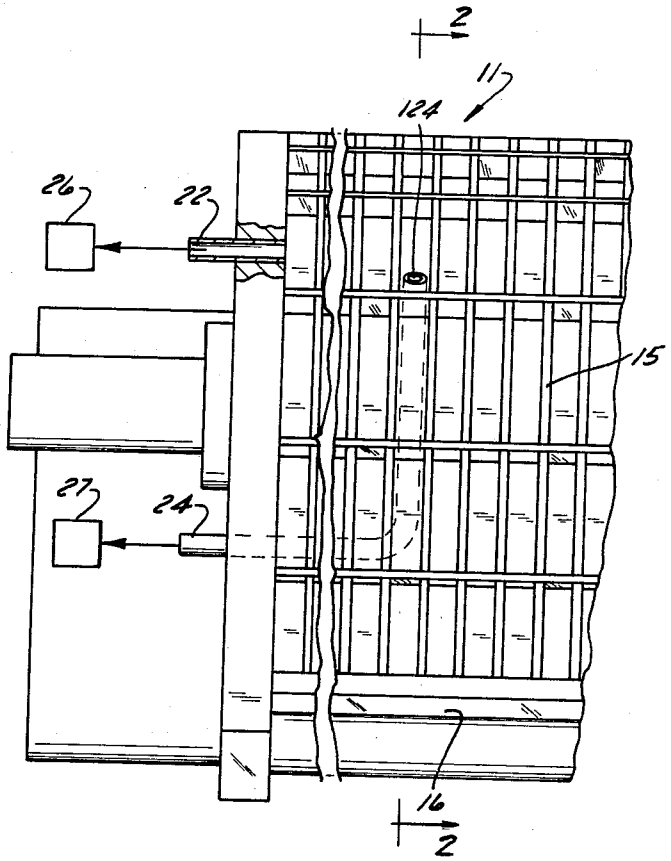
FIG. 3 is a plan view of a portion of the web turning guide shown in FIG. 2.
Figure 2:
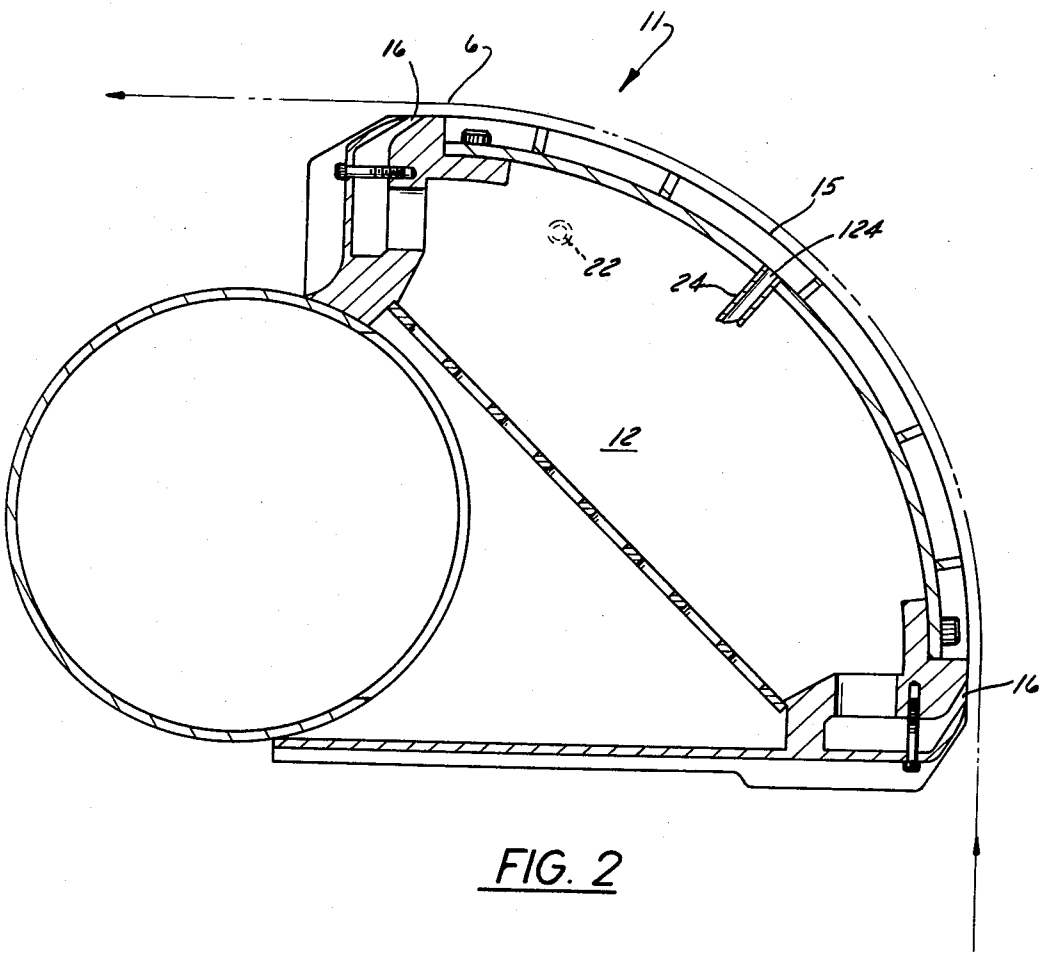
FIG. 2 is a view in vertical section, taken along line 2—2 in FIG. 3 of a web turning guide comprising a part of the apparatus shown in FIG. 1.

In the accompanying drawings the numeral 5 generally designates a web press or coating machine wherein a running web 6 is drawn forward from a supply roll 7 at the rear end of the machine and through coating or imprinting rolls 8 to forwarding rolls 9 near the front of the machine. A stretch of web 6 that extends forward from the coating or imprinting rolls 8 to a heated drying chamber 10 must be prevented from contacting any part of the machine, to prevent smearing or other defacement of the fresh coating or printing on the web. The means for effecting such contactless support of the web 6 comprises a succession of turning guides 11, each of which controls the web for a predetermined change of direction.

The turning guides 11 are generally conventional, each comprising a plenum chamber 12 into which pressurized supply air is fed from a source thereof that can be a blower or air pump 14. Each turning guide has a curved external guiding surface 15 that is substantially a cylinder segment. Pressure air issues from the plenum chamber 12 through slots 16 that extend circumferentially along axially opposite portions of the guiding surface 15, and these slots 16 are so arranged that the pressure air issuing from them tends to be blown laterally inwardly under the web to provide a cushion of pressurized air on which the web floats, out of contact with the surface 15 and at a small distance from it, said distance being herein referred to as the web clearance.

Since the web 6 is pulled forward through the machine 5, it is under a lengthwise tension which remains substantially constant only while the apparatus is in normal operation. But when the apparatus is being shut down or started, or when the application of printing impressions or coating is switched on or off, web tension changes; and for maintenance of a constant web clearance there must be a corresponding change in the pressure of air in the air cushion on which the web moves around the turning guide.

The pressure of air in the air cushion depends upon pressure of air in the plenum chamber 12, and therefore maintenance of a constant web clearance under varying web tension requires that the flow of supply air into the plenum chamber be increased or decreased in general correspondence with any increase or decrease in web tension. For adjustment of the flow of supply air into the plenum chamber 12 the apparatus comprises an air damper or adjustable throttling valve 17 in the duct system 18 that communicates the outlet of the blower 14 with the inlet to the plenum chamber of each turning guide.

In accordance with the present invention, the damper 17 is automatically adjusted to maintain a constant web clearance, but instead of controlling the damper on the basis of a constant sensing of web clearance distance, as heretofore proposed, the invention takes advantage of a pressure relationship that has not heretofore been appreciated.

Specifically, it has been demonstrated both theoretically and experimentally that the web clearance distance is directly related to the ratio of above-atmospheric supply pressure to above-atmospheric air cushion pressure. This is to say that if the ratio of above-atmospheric supply pressure to above-atmospheric air cushion pressure is maintained constant, then the web clearance will remain substantially constant, notwithstanding variations in web tension. Within the practical range of web tensions, deviations from constant web clearance caused by effects of air compressibility and web stretch are very small. Accordingly, the present invention contemplates control of web clearance on the basis of constant measurement of pressure in the air cushion between the web and the surface 15 of the turning guide, constant measurement of the pressure of supply air that is in the plenum chamber 12 or is being fed into it, and adjustment of the damper 17 as necessary to maintain a constant ratio relationship between those measured pressures. It is to be observed that the basic ratio relationship to be maintained constant is one between above-atmospheric pressures. Thus if, $P_s$=absolute supply pressure, $P_c$=absolute cushion pressure, and $P_a$=atmospheric pressure, then the relationship to be maintained for maintenance of a constant web clearance can be variously expressed as:

$(P_c-P_a)/(P_s-P_a)$=a constant, or $(P_s-P_a)/(P_c-P_a)$=a constant, or $(P_s-P_c)/(P_s-P_a)$=a constant, or $(P_s-P_c)/(P_c-P_a)$=a constant.

In practical apparatus embodying the present invention, comprising a plurality of turning guides 11 that are connected with the outlet of a single blower 14 in parallel with one another, it is necessary to sense supply air pressure and cushion air pressure at only one of the turning guides, inasmuch as web tension is substantially the same at every turning guide. The apparatus can therefore comprise a single automatically controlled damper 17 that controls air flow between the outlet of the blower 14 and a location 20 at which the duct system 18 branches to the plenum chambers of the several turning guides 11. For adjustment of the web clearance distance maintained at each individual turning guide 11, each of the branch ducts 18' that leads to an individual turning guide can have a manually adjustable damper 21.

The monitored turning guide 11' at which pressures are sensed has two pressure taps 22 and 24. The tap 22 is a supply air pressure tap that comprises a tube which projects into the plenum chamber 12 of the monitored turning guide, as from one side thereof, and which has an open inlet end in that plenum chamber (as illustrated) or in the pressure air supply duct 18 ahead of that plenum chamber. At the opposite end of the supply air pressure tap there is a supply pressure transducer 26 which produces an electrical output signal having a magnitude that corresponds to a function of supply air pressure. A commercially available device suitable for the purpose is the "Micro Switch" 142 PC05G pressure transducer.

The tap 24, which serves for sensing cushion air pressure, comprises a tube that has an inlet end 124 at the curved guiding surface 15, at a location substantially inboard of the air outlet slots 16, preferably midway between those slots. If the turning guide is to be used with narrow webs run at different lateral positions, it can have several taps, one for each web position, each having its inlet end so located as to be about midway between the edges of a web for which it is intended. The opposite end of the tube 24 is connected with a second pressure transducer 27, which can be identical to the transducer 26 and which thus produces an electrical output signal having a magnitude that corresponds to a function of cushion air pressure. If there are several tap tubes, for cooperation with narrow webs run at different lateral positions, only the operative tap tube will be connected with the pressure transducer 27 and the others can be plugged or capped at their outer ends to prevent loss of cushion air pressure through them.

The supply air pressure output from the transducer 26 and the cushion air pressure output from the transducer 27 are both fed to a ratio device 29, which produces a ratio signal corresponding to a ratio function of those outputs. Within the ratio device there is also produced a set-point signal that corresponds to a function of the desired web clearance distance; and on the basis of a comparison of the ratio signal with the set-point signal the ratio device 29 produces a control output having a sign and magnitude that corresponds to the departure of the prevailing ratio signal from the desired set-point value.

The set-point signal is generated by a set-point signal generator 31, which can comprise a part of the ratio device 29 and which is controllable as to its output by means of a manual adjustment device 32 that can be a potentiometer or the like. The ratio device 29 also can comprise a ratio-forming device 33, to which the pressure signal outputs from the transducers 26 and 27 are fed, and a comparison device 34 which receives inputs from the set-point signal generator 31 and from the ratio forming device 33 and which issues the control output. A commercially available unit that is suitable to serve as the ratio device is the "Eurotherm" model 929; and it is preferably modified, by a capacitor change that will be obvious to those skilled in the art, to provide a substantially shorter correction or resetting time than it has as normally sold.

The control output of the ratio device 29 controls energization of a servo 30 that actuates the damper 17, causing opening and closing of that damper in accordance with changes in the ratio relationship and in the direction to restore the output of the ratio device to the substantially constant set-point value. A commercially available servo motor suitable for damper actuation is Honeywell's "Actionator" Type M940A1000.

The damper 17 and its actuating servo 30 are so arranged that the damper can never be completely closed. Normally, with no web present the damper 17 tends to be closed, inasmuch as there is zero air cushion pressure and the system tends to reduce supply air flow to maintain the required pressure ratio. If the damper were permitted to close completely, the system would detect an indeterminate pressure relationship (zero divided by zero) and would not be able to resume automatic control in response to the presence of a web.

From the foregoing description taken with the accompanying drawings it will be apparent that this invention provides a method and apparatus for so controlling the flow of supply air to a contactless web turning guide as to maintain a substantially constant distance between the web and the curved guiding surface of the turning guide, notwithstanding substantial variations in web tension. It will also be apparent that the method and apparatus of this invention involves no measurement of the web clearance distance but instead provides for control of the flow of supply air to the turning guide on the basis of a ratio relationship between easily measured pressures, and it therefore requires only relatively simple, inexpensive and easily available apparatus for its implementation.

I claim:

1. In a contactless web guiding apparatus comprising a turning guide having an exterior curved surface which a running web follows for change in its running direction and having a plenum chamber into which pressurized supply air is fed and from which air issues through outlets that open to said surface to provide a pressurized air cushion between said surface and the web whereby the web is held at a distance from said surface, and controllable means for delivering pressurized supply air to the plenum chamber at an adjustably variable rate, automatic means for so controlling said controllable means as to cause said distance between the web and said surface to be maintained substantially constant notwithstanding variations in web tension, said automatic means comprising:

A. supply pressure sensing means arranged to produce a supply pressure output substantially corresponding to a function of the pressure of supply air in said plenum chamber;

B. cushion pressure sensing means having an inlet at said surface and arranged to produce a cushion pressure output substantially corresponding to a function of the pressure of air in said air cushion;

C. ratio means connected with said supply pressure sensing means and said cushion pressure sensing means to receive their outputs and arranged to produce a ratio signal that corresponds to a function of a ratio relationship between said supply pressure output and said cushion pressure output;

D. demand value means for generating a set-point signal substantially corresponding to a desired value of said distance;

E. comparison means connected with said demand value means and said ratio means for producing a control output substantially corresponding to the prevailing difference between said set-point signal and said ratio signal; and F. means connected between said comparison means and said controllable means for impressing said control output upon said controllable means.

2. Apparatus for controlling a running web, comprising a contactless turning guide that comprises a plenum chamber into which pressurized supply air is fed, an exterior curved surface that the web follows for change in its running direction, and outlets through which air issues from the plenum chamber to maintain a pressurized air cushion between said surface and the web whereby the web is held at a distance from said surface, a damper for controlling the flow of pressurized supply air from a source thereof into said plenum chamber, and servo means for adjusting said damper to vary the pressure of supply air in the plenum chamber, said apparatus being characterized by:

A. a first sensor having an inlet at said surface and arranged to produce a cushion air output substantially corresponding to the pressure of air in said air cushion;

B. a second sensor arranged to produce a supply air output substantially corresponding to the pressure of air in said plenum chamber; and C. comparison means having input connections with said first and second sensors and arranged to produce a control output corresponding to prevailing departure from a predetermined value of a ratio relationship between said cushion air output and said supply air output, said comparison means having an output connection with said servo means whereby the latter is caused to so adjust the damper as to maintain said ratio relationship substantially constant at said predetermined value.

3. The apparatus of claim 2 wherein said comparison means comprises:

(1) demand value means for generating a set-point signal corresponding to said predetermined value;

(2) ratio forming means connected with said first and second sensors and arranged to produce a ratio signal corresponding to the prevailing value of said ratio relationship; and (3) comparison means having input connections from said demand value means and said ratio forming means and having an output connection with said servo means, said comparison means being arranged to produce an output that corresponds in sign and magnitude to the prevailing difference between said set-point signal and said ratio signal.

4. The apparatus of claim 3 wherein said demand value means is manually adjustable so that the predetermined value to which its set-point signal corresponds is the desired distance between the web and said curved surface.

5. A method of operating apparatus comprising a contactless turning guide which controls a running web for a change in direction along its length and which comprises a plenum chamber into which pressurized supply air is fed, an exterior curved surface that the web follows for change in its running direction, and outlets through which air issues from said plenum chamber for maintenance of a pressurized air cushion between said surface and the web whereby the web is held at a distance from said surface, said method enabling said distance to be maintained substantially constant notwithstanding substantial variations in web tension and being characterized by:

A. measuring the pressure of air in said air cushion at a location adjacent to said surface; and B. so controlling the pressure of air in said plenum chamber as to maintain the same in a substantially constant ratio relationship to pressure of air in said air cushion.

6. A method of operating apparatus comprising a contactless turning guide which controls a running web for a change in direction along its length and which provides an exterior curved surface that the web follows for change in its running direction, a plenum chamber into which pressurized supply air is fed, and outlets through which air issues from said plenum chamber for maintenance of a pressurized air cushion between said surface and the web whereby the web is held at a distance from said surface, said apparatus also comprising an adjustable damper for controlling the flow of supply air from a source thereof to said plenum chamber, said method being characterized by:

A. measuring the above-atmospheric pressure of air in said cushion;

B. measuring the above-atmospheric pressure of air in said plenum chamber; and

C. adjusting said damper to maintain a substantially constant ratio relationship between said above-atmospheric pressures, to thereby maintain a substantially constant distance between said surface and the web irrespective of variations in web tension.

7. A method of operating apparatus comprising a contactless turning guide which controls a running web for a change in direction along its length and which provides an exterior curved surface that the web follows for change in its running direction, a plenum chamber into which pressurized supply air is fed, and outlets through which air issues from said plenum chamber for maintenance of a pressurized air cushion between said surface and the web whereby the web is held at a distance from said surface, said apparatus also comprising an adjustable damper for controlling the flow of supply air from a source thereof to said plenum chamber, said method being characterized by:

A. producing a cushion air output corresponding to the above-atmospheric pressure of air in said cushion;

B. producing a supply air output corresponding to the above-atmospheric pressure of supply air downstream from said damper;

C. producing a ratio signal corresponding to a ratio relationship between said cushion air output and said supply air output;

D. producing a substantially constant set-point signal comparable with said ratio signal; and E. controlling said damper in accordance with the magnitude and sign of the difference between said ratio signal and said set-point signal.

8. Contactless web guiding apparatus comprising a turning guide that provides a plenum chamber into which pressurized supply air is fed, a curved exterior guiding surface that a web follows for a change in its running direction, and outlets through which air issues from said plenum chamber for maintenance of a pressurized air cushion between said surface and the web whereby the web is held at a distance from said surface, and a movable damper for regulating flow of pressurized supply air from a source thereof to said plenum chamber, said web guiding apparatus being characterized by:

A. cushion pressure sensing means having an inlet at said surface and arranged to produce a cushion pressure output which is a function of the above-atmospheric pressure of air in said air cushion;

B. supply pressure sensing means responsive to the pressure of air in said plenum chamber and arranged to produce a supply pressure output which is a function of the above-atmospheric pressure of air in said plenum chamber;

C. ratio forming means connected with said cushion pressure sensing means and with said supply pressure sensing means and arranged to produce a ratio signal that is a function of a ratio relationship between said cushion pressure output and said supply pressure output;

D. demand signal means for producing a set-point signal which is comparable with said ratio signal and which substantially corresponds to a desired value of the distance between the web and said surface;

E. comparison means connected with said ratio forming means and said demand signal means, for producing a control output having a magnitude and sign that correspond to the difference between the ratio signal and the demand signal; and F. a servo (1) connected with said damper for adjustingly moving the same; and (2) connected with said comparison means to receive said control output and to respond thereto by so positioning the damper as to tend to maintain said control output at a substantially constant value, so that said distance between the web and said surface remains substantially constant notwithstanding changes in web tension.

* * * * *